United States Patent [19]

Ernst et al.

[11] 4,299,474

[45] Nov. 10, 1981

[54] COMPONENT MOUNTING APPARATUS USEFUL FOR COMPACT COPIERS

[75] Inventor: Larry M. Ernst; William E. McCollum, both of Longmont; Carl A. Queener, Lyons; Bernard L. Wilzbach, Longmont, all of Colo.

[73] Assignee: International Business Machines Corporation, Armonk, N.Y.

[21] Appl. No.: 107,216

[22] Filed: Dec. 26, 1979

[51] Int. Cl.[3] ..... G03G 15/00

[52] U.S. Cl. ..... 355/3 DR; 355/110; 355/117

[58] Field of Search ..... 355/3 DR, 16, 47–49, 355/85, 104, 105, 108, 110, 117

[56] References Cited

U.S. PATENT DOCUMENTS

| | | | |
|---|---|---|---|
| 2,876,277 | 3/1959 | Badger et al. | 174/52 |
| 3,491,684 | 1/1970 | Borinsky | 101/132 |
| 3,642,368 | 2/1972 | Moss | 355/47 |
| 3,684,362 | 8/1972 | Weigl | 355/3 DR |
| 4,087,177 | 5/1978 | Gumm et al. | 355/47 |
| 4,161,357 | 7/1979 | Herman et al. | 355/3 DR |
| 4,165,169 | 8/1979 | Miyashita et al. | 355/3 DR |

FOREIGN PATENT DOCUMENTS 450168 4/1968 Switzerland .

OTHER PUBLICATIONS

*IBM Technical Disclosure Bulletin,* "Drum Seal Interlock", Brown et al., vol. 20, No. 10, Mar. 1978, pp. 3837–3838.

*IBM Technical Disclosure Bulletin,* "Module Housing", Ernst et al., vol. 20, No. 12, May 1978, pp. 5116–5117.

*Primary Examiner*—Richard A. Wintercorn
*Attorney, Agent, or Firm*—Earl C. Hancock

[57] ABSTRACT

Electrical components in an elongated array are suspended within the interior of a sleeve type closed loop member such as a rotatable photoconductor drum or closed loop belt of a compact copier. Preferably some of the components are mounted on a board and held within the sleeve by edge slots or the like in sleeve mounting end caps, attached to the machine frame. A drive motor can be attached as part of the array and further can be arranged to drive a fan blade so that cooling air is forced through the sleeve and over the components so that the sleeve acts as a plenum. Power can be coupled from the drive motor through the end mounts to motivate the sleeve in the direction of its closed loop and/or apply power to other components of the copier.

13 Claims, 8 Drawing Figures

COMPONENT MOUNTING APPARATUS USEFUL FOR COMPACT COPIERS

DESCRIPTION

1. Field of the Invention

The present invention relates to methods and means for positioning electrical components in an office copier or duplicator. More particularly, the present invention relates to methods and means for mounting various elements and especially electrical components associated with the operation of a copier/duplicator so that maximum economy of volumetric space is realized. The present invention significantly facilitates design and fabrication of compact copier units. Although not necessarily limited thereto, the present invention is particularly useful for low cost, table-top type office copier/-duplicators.

2. Description of the Prior Art

There has been a continued interest for many years in designing and producing copier/duplicator machines which are adequately compact so that they can be used as a table-top device. An important concern in such machines is in maximizing utilization of the volumetric space within the frame covers. In systems wherein entire document images are placed on an elongated photoconductive surface which is typically formed as a closed loop belt or drum, the belt or drum must necessarily enclose a relatively large volumetric space, thereby demanding a considerable proportion of the interior volume of such a machine. These belts or drums are mounted for movement in their closed loop direction so as to receive the image from the original document and to pass through the various functional stages of the copier for the purpose of transferring the received image to copy sheets.

The interior of the photoconductive belts or drums have been used for some purposes in prior art devices. For instance, rolls of photoconductive material have been positioned within the drums and arranged to be fed onto the peripheral surface of the drum and returned to take-up spools within the drum. Others such as U.S. Pat. No. 3,642,368 by Moss have mounted optical elements and illumination lamps within transparent rotating drums so as to transfer images from one interior peripheral edge to an opposite edge. Moss likewise removes heat from the lamps rotatably mounted within the drums by forcing cooling air coaxially through the drum. All such devices known in the prior art have attached the elements to the interior of the drum so that they rotate with the drum, thereby requiring slip ring power connections or the like, which is highly undesirable for reliability.

Although static mounting of electrical components within fixed cylindrical cans has been known as in U.S. Pat. No. 2,876,277 by Badger et al, assigned to the same assignee as the present application, none of the prior art is known to have statically suspended electrical components associated with the control and operation of a copier/duplicator within the internal environs of a moving photoconductive belt or a rotating photoconductive drum.

SUMMARY OF THE INVENTION

The present invention is concerned with apparatus for mounting electrical components within a closed loop sleeve such as a movable belt or a rotatable drum in a manner which permits realization of maximum space utilization in a copier/duplicator machine. More particularly, the present invention relates to apparatus wherein a closed loop sleeve is mounted relative to the machine frame so that the sleeve can move in the direction of its closed loop. An elongated assembly, including a member having the electrical components associated with operation of the apparatus attached thereto, is arranged with transverse dimensions for fitting within the sleeve so as to allow the sleeve to move around the assembly member. The assembly is attached to the frame at at least one end of the sleeve so that it is securably received in suspended relation within the sleeve.

An additional and particularly advantageous feature of the present invention resides in including fan means mounted for driving cooling air through the sleeve and over the member with its electrical components so that the sleeve performs a dual function of both photoconductive surface support and plenum chamber for cooling of the components. A still further feature resides in including a drive motor with the assembly mounted in-line with the member. This drive motor can be arranged to power the fan blade for cooling and/or applying motivational power to the sleeve in the direction of the closed loop thereof or allowing power take-off to other elements associated with operation of the copier.

Accordingly, the present invention allows significant reduction in overall machine volume without significant extra part cost increase. It is particularly important for low cost office copiers configured as small, table-top machines.

The foregoing and other objects, features, advantages, and applications of the present invention will be readily apparent to those having normal skill in the art from the following more detailed description of the exemplary preferred embodiment as illustrated in the accompanying drawings.

DETAILED DESCRIPTION OF THE PREFERRED EMBODIMENTS

Figure 1:
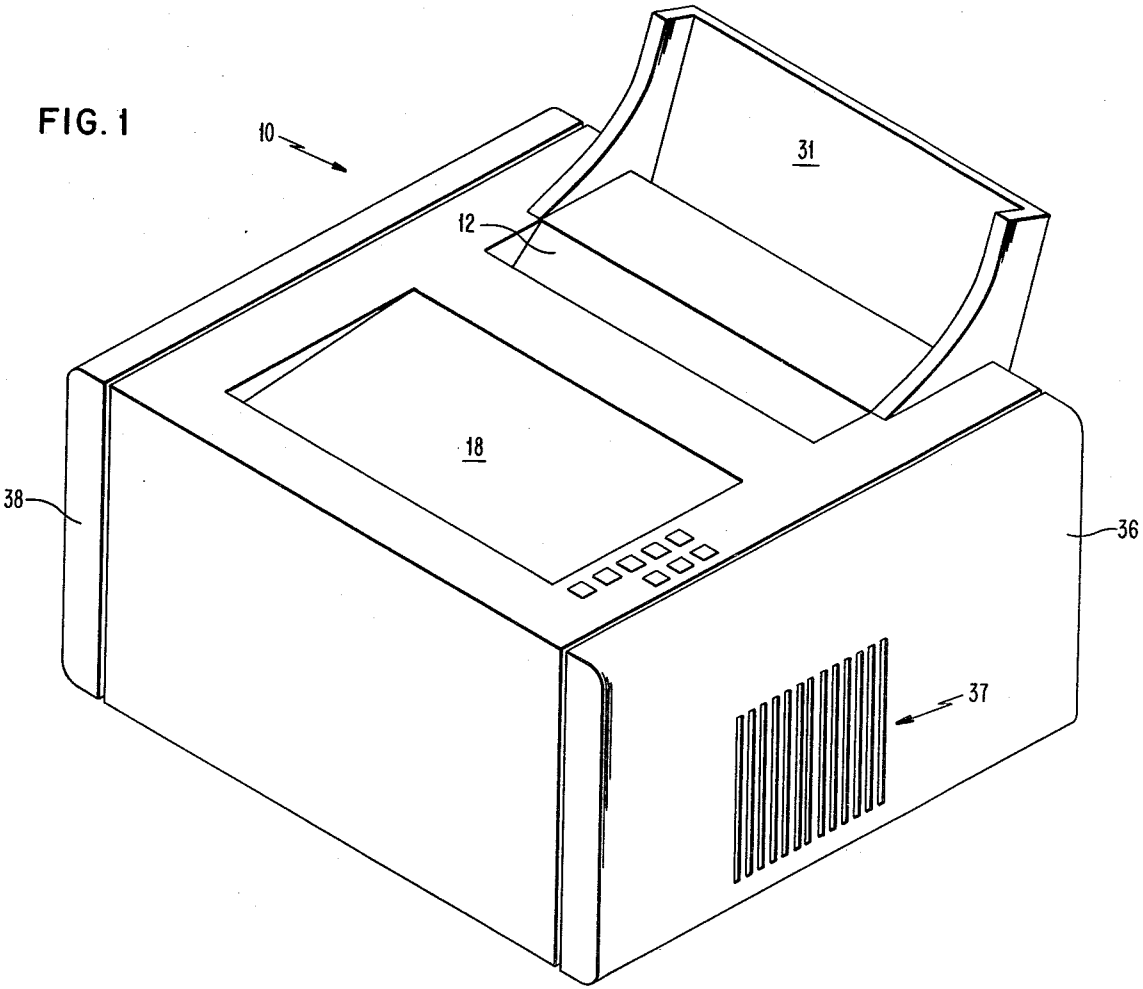
FIG. 1 is an isometric view of an exemplary office copier incorporating the present invention.

FIG. 1 illustrates an isometric view of a compact office copier which advantageously utilizes the present invention. Operation of copier 10 can best be understood by concurrently considering FIGS. 1 and 2, but it is to be understood that this particular copier and its operating sequences are exemplary only, and the present invention is not necessarily limited to the machine as described below.

A cassette 11 containing a supply of copy sheets is initially inserted into the machine after which original documents are introduced to in-feed slot 12 by the user. The original document, by appropriate gating and drive rollers, is moved into the nip formed by the photoconductive drum 15 and a transparent roller 16 which is positioned in surrounding relation to an illumination lamp 17. Thus as the document which is inserted with the side to be copied facing drum 15 passes through the nip formed by drum 15 and roller 16, an image is electrostatically formed on the surface of drum 15. The original document is then either transferred to the output tray 18 or appropriately gated to recirculate a preselected number of times around the closed loop feed track 20.

The electrostatic image on the photoconductive surface of drum 15 passes by developer 22. Copy sheets are fed from supply cassette 11 into path 25A so as to pass transfer corona 26, thereby receiving the developed image from the surface of drum 15. The copy sheet then is detached from drum 15 and delivered to the nip formed by fuser rollers 27 and 28 where the image is fixed to the copy sheet. The copy sheet is then delivered through output path 25B to the copy sheet tray 30 where they are accessible to the user. Note that longer length output copy sheets rest in part on the upper surface 31 of output tray 30. Corona 35 provides precharging of the photoconductive surface immediately prior to image transfer.

Figure 2:
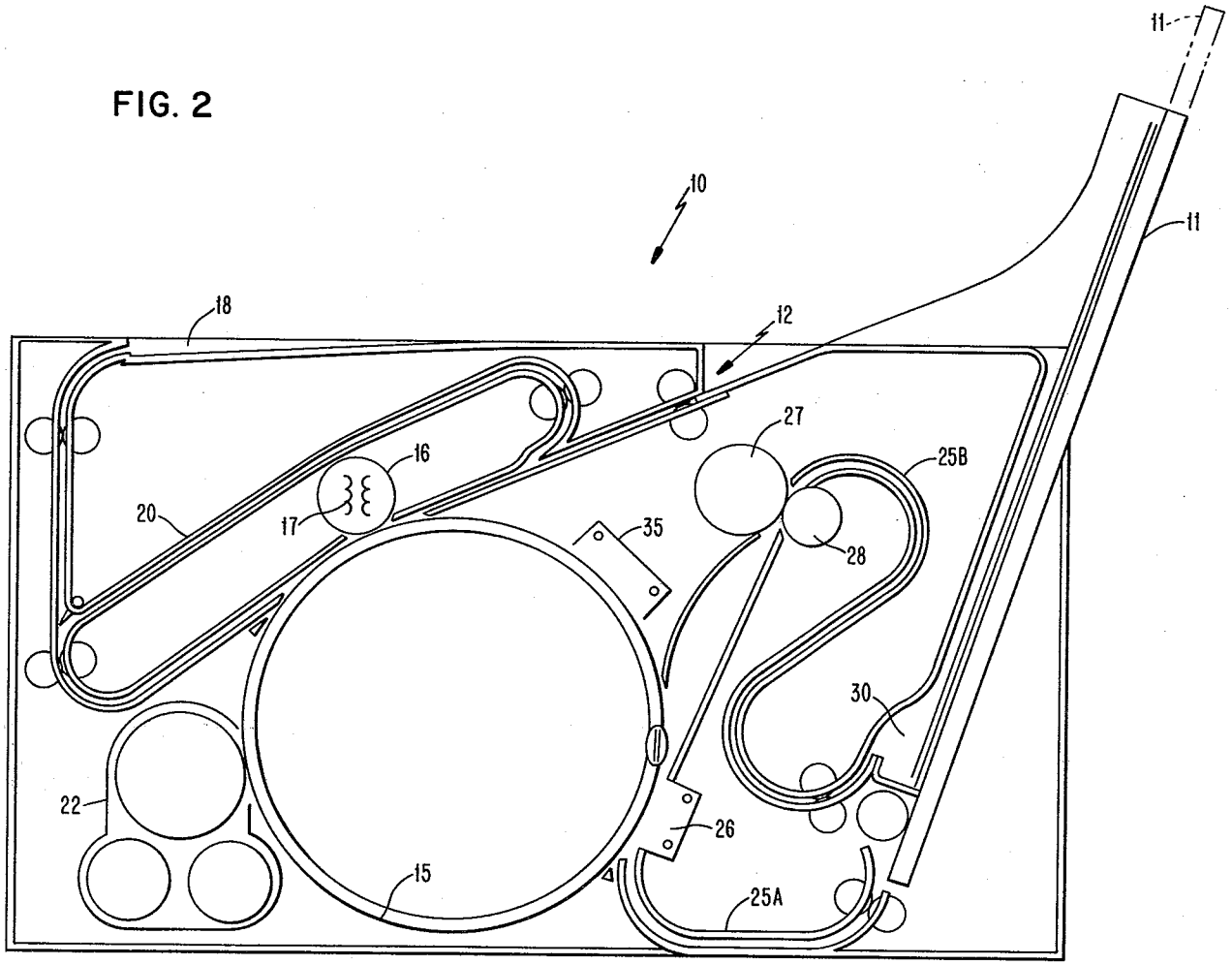
FIG. 2 is a side, partially sectioned and partially schematic, view of the FIG. 1 copier.

The particular machine shown in FIGS. 1 and 2 is a so-called two-cycle machine wherein the drum 15 photoconductive surface is effectively cleaned during one cycle and the image is transferred from the original document to a copy sheet during the next cycle. Thus the developer 22 which is a conventional magnetic brush-type device operates as a developer during the image transfer cycle, but as a cleaning device during the clean cycle. Conversely, coronas 26 and 35, as well as lamp 17 operate for appropriate transfer and/or cleaning charge functions during each of those two cycles as is well known in the art. The particular operation of the machine shown in FIGS. 1 and 2 is exemplary only and forms no part of the present invention.

In FIG. 1, side panel 36 of the machine covers is specifically shown as including a plurality of slots 37 which allow air to enter and/or exit from the interior of the machine. Slots 37 are arranged so as to be in generally coaxial alignment with drum 15 and a similar set of slots [not shown] are incorporated in the other side cover 38.

Figure 3:
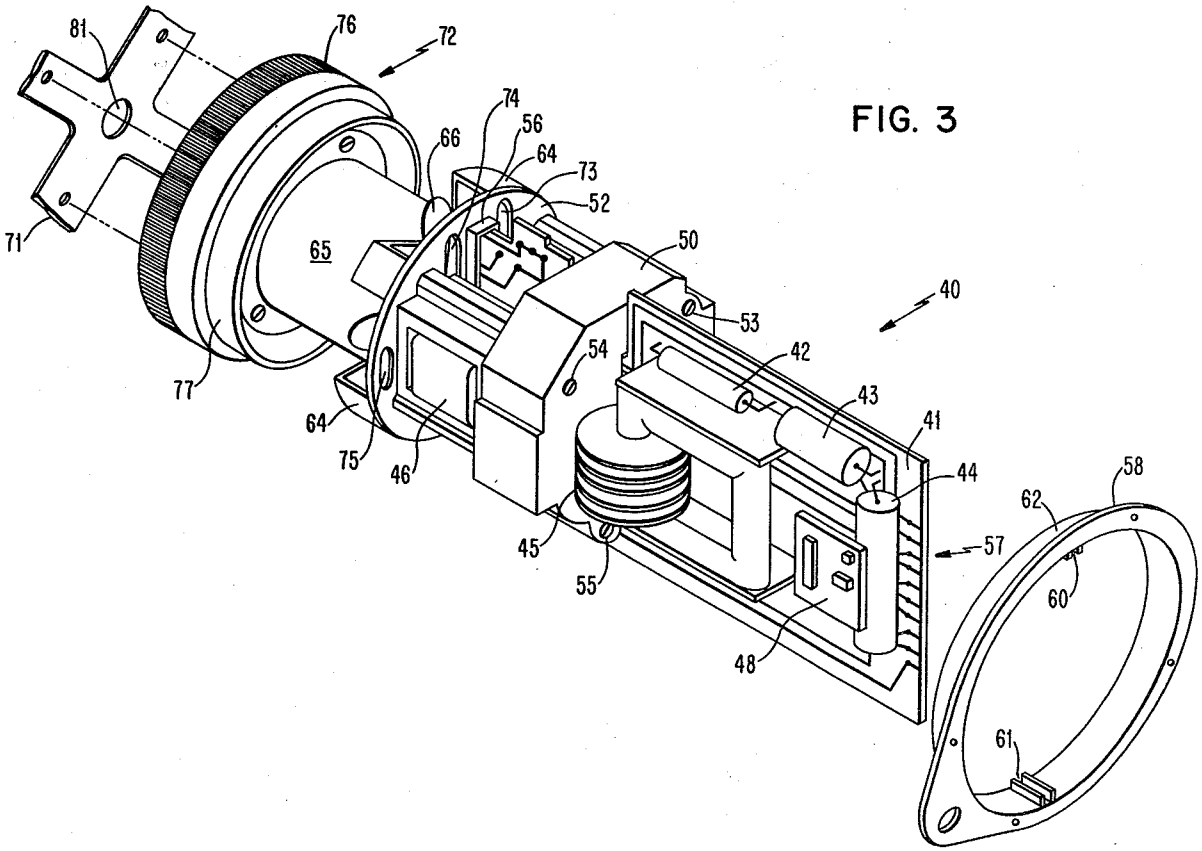
FIG. 3 is an isometric view in partially exploded relation illustrating the electrical component mounting arrangement within the photoconductive drum of FIGS. 1 and 2.

An exemplary assembly 40 of electrical components suspendable within the interior of drum 15 is shown in FIG. 3. Elongated assembly 40 includes a component mounting board 41 shown here somewhat in the pattern of a printed circuit board configuration. Board 41 has attached thereto a series of typical electrical elements such as tubular capacitors 42, 43, and 44, special purpose transformer 45, power transformer 46, and subassembly 48 which can include various circuit chips and the like, including a microprocessor. Board 41 has a notch therein over which is placed a molded module assembly 50 which can be constructed similarly to that shown in the IBM Technical Disclosure Bulletin of May 1978 in the article entitled "Module Housing" by Ernst et al, at pages 5116–5117.

An interfacing plate 52 is retained in position by screws and standoffs 53–55 which further cooperates with the module 50 retaining slot in board 41 to hold board 41 in the channel 56 on the face of plate 52 as shown. These components are appropriately connected through various conductors into edge connector 57 for electrical communication outside of the end of the drum 15. A collar 58 fits through the machine frame [59 in FIG. 4] and includes grooves 60 and 61 for the purpose of retaining board 41 in its suspended position within drum 15. Further, a bearing surface 62 is formed integrally with collar 58 to extend inside the frame and allow the inner surface of drum 15 to rotate thereon.

The assembly 40 is completed by an attachment cage 64 and drive motor 65. Cage 64 is comprised of a plurality of L-shaped legs extending from interfacing plate 52 and attaching to the end face of drive motor 65. The L-shaped legs of assembly 64 form a protective cage around fan blade 66. Fan blade 66 is attached to the drive shaft of motor 65 so that air can be pulled from frame member 70 through the openings between the slotted X-shaped arms 71, further through the hollow interior of the gear assembly 72 and thence over motor 65 and through plate 56 as by slots 73, 74, and 75. The air forced through slots 72–75 passes over all the other electrical components associated with board 41 and exhausts outwardly through collar 58 and ultimately out one of the slot arrangements in the cover as illustrated in FIG. 1. Drum 15 effectively provides an elongated plenum for air flow over assembly 40. Although not shown in the exemplary preferred embodiments, air filters can be included at any one or more locations between the inlet or exhaust openings.

Gear assembly 72 includes a peripheral gear portion 76 and a reduced shoulder 77 to which the drum 15 is directly attached. An inner collar [not shown] is attached to frame 70 and provides a bearing surface shoulder on which assembly 72 can rotate when the entire machine is assembled. Attachment of drum 15 to assembly 72 at one end and the placement of the other end of drum 15 over bearing surface 62 results in the drum being held in position substantially as shown in FIG. 4.

Figure 4:
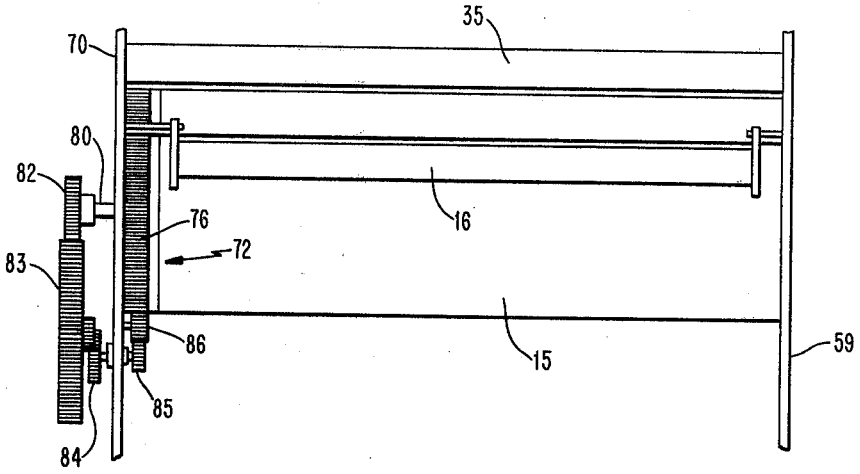
FIG. 4 is a top view of the mounted drum of FIGS. 1–3, particularly illustrating a gearing arrangement for transferring operating power from the internally mounted drive motor to external components associated with the copier.

In FIG. 4, the mechanical power coupling to drive other elements of the copier and to provide rotary power to drum 15 is illustrated. More particularly, drive shaft 80 attached to motor 65 extends through hole 81 [note FIG. 3] through side frame 70. Output shaft 80 is coupled by means of gears 82–86 so as to drive gear segment 76 of end assembly 72, and thus rotate drum 15 around the electrical mounting assembly 40. Note that further power take offs can be arranged either by direct gearing or through clutches or the like for operating the developer/cleaner 22, the various drive rollers and other elements of copier 10 as generally illustrated in FIG. 2 and described previously.

Figures 5, 6:
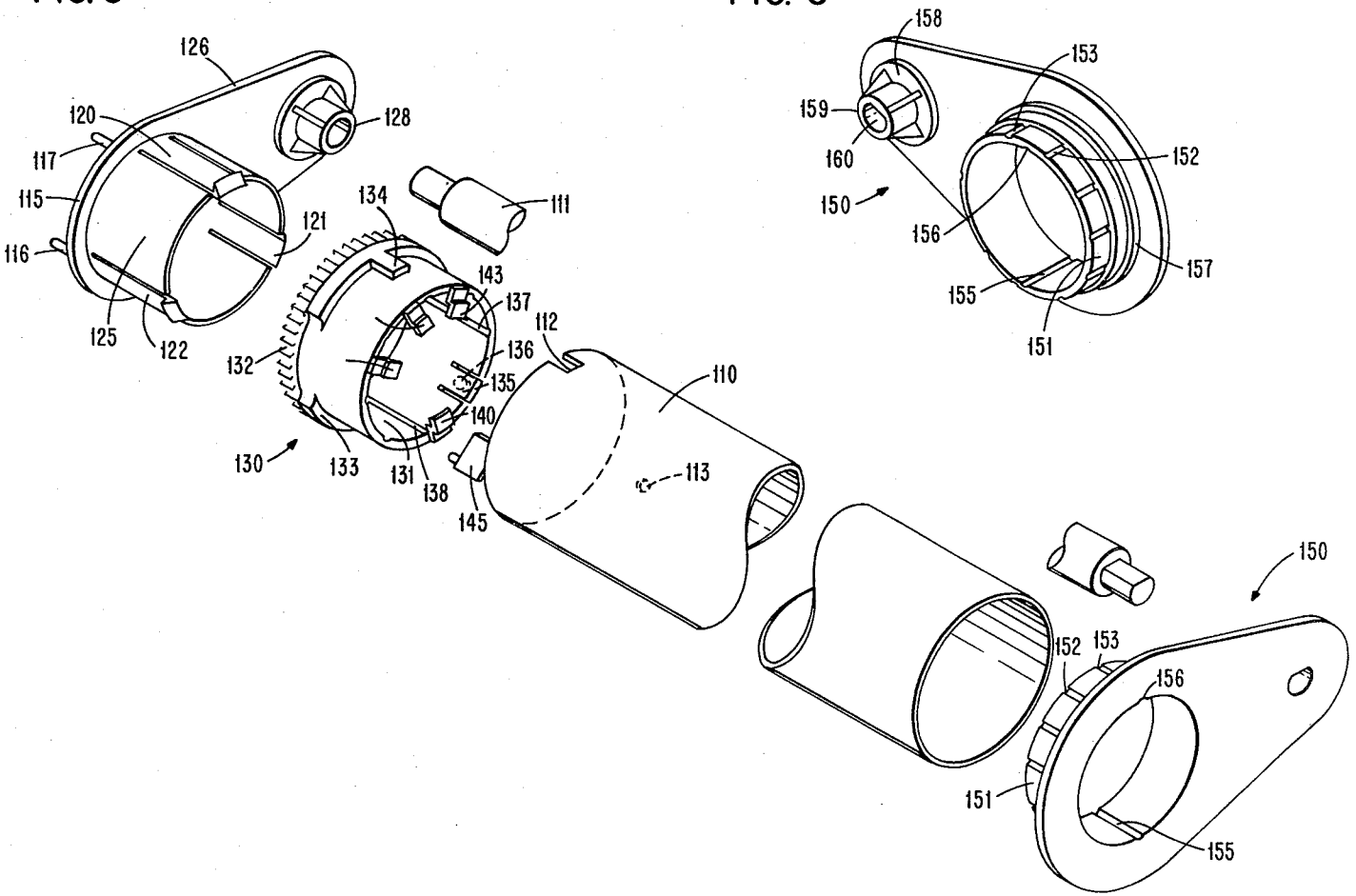
FIG. 5 is an exploded and partially broken isometric view of another copier drum mounting assembly adapted for inclusion in the present invention.
FIG. 6 is an isometric view of the spider plate end mount of FIG. 5.

An alternate arrangement for mounting a drum is shown in FIGS. 5 and 6. In this configuration, each element of a drum 110 mounting assembly is formed of a molded configuration, including a portion adapted for performing multiple functions associated with the drum mounting. The assembly of FIGS. 5 and 6 provides mounting of both photoconductor surfaced drum shell 110 and magnetic brush roll spindle 111. Stub plate 115 includes a plurality of locating rivet such as 116 and 117 molded integrally therewith to accurately locate plate 115 when inserted into pilot holes on a machine frame [not shown]. Rivet such as 116 and 117 can be hot upset to attach plate 115 to the machine frame. Spring fingers 120, 121, and 122 allow gear and cam element 130 to be snapped into position over fingers 120–122 to retain element 130 against lateral movement, but to allow bearing surface interaction between external circumferential surface 125 of element 115 and interior circumferential surface 131 of element 130. Flange 126 includes a bearing support 128 for receiving the rotating end of a magnetic brush roll spindle 111.

Unitary molded element 130 performs multiple functions including the imparting of rotary movement to drum shell 110 through gear 132 and a meshing drive gear [not shown] similar to that illustrated in FIG. 4. A first cam surface 133 provides paper path gate mechanism actuation. Index key and drum shell driver 134 cooperate with slot 112 of drum 110 to positionally index drum shell 110 and to establish a rotary driving lug coupling. Spring tab 135 includes a radially extending external stub 136 for cooperation with drum hole 113 to provide positive drum positioning and allow drum shell 110 to be removed by springing of tab 135. Grooves such as 137 and 138 provide lubricant and debris collecting operations.

Also molded into the inner radial face of element 130 are emitter ring components to provide timing pulses for machine operation. A wide cam lobe 140 and a plurality of narrow cam lobes 141–143 cooperate with stationary emitter switch 145 so that a "home" pulse is produced as cam 140 is sensed by switch 145, whereas lobes 141–143 produce machine operation controlling pulses. Cam lobes 140–143 are integrally molded into the face of element 130, but can be made adjustable in a circumferential direction to correct timing pulse spacing.

The opposite end of drum shell 110 and magnetic brush spindle 111 is mounted by spider plate 150 which locates the drum center line in relation to the magnetic roll of the magnetic brush developer. A bearing surface 151, on which drum 110 rotates, includes additional grooves such as 152 and 153 for lubricant and debris collection. Slots 155 and 156 provide a guide and support for a printed circuit card or the like similar to that illustrated in FIG. 3. Locating bosses 157 and 158 position spider plate 150 on the machine frame [not shown]. Developer support boss 159 retains the magnetic brush roll spindle 111 in place and the keyed hole 160 therethrough sets the magnetic orientations and supports spindle 111 for the magnetic brush roll.

Figure 7:
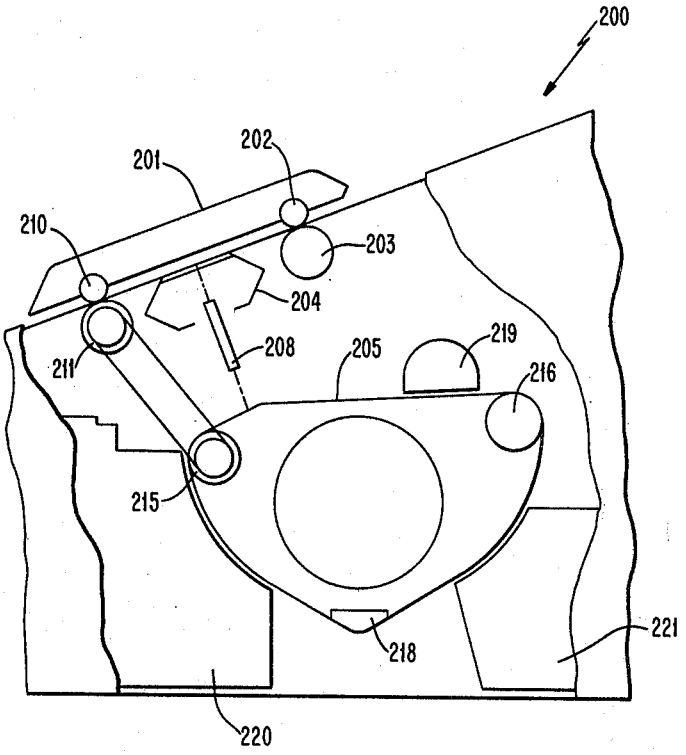
FIG. 7 is a side, partially sectioned and partially schematic, view of a portion of a copier having a closed loop sleeve or belt for the photoconductor element.
Figure 8:
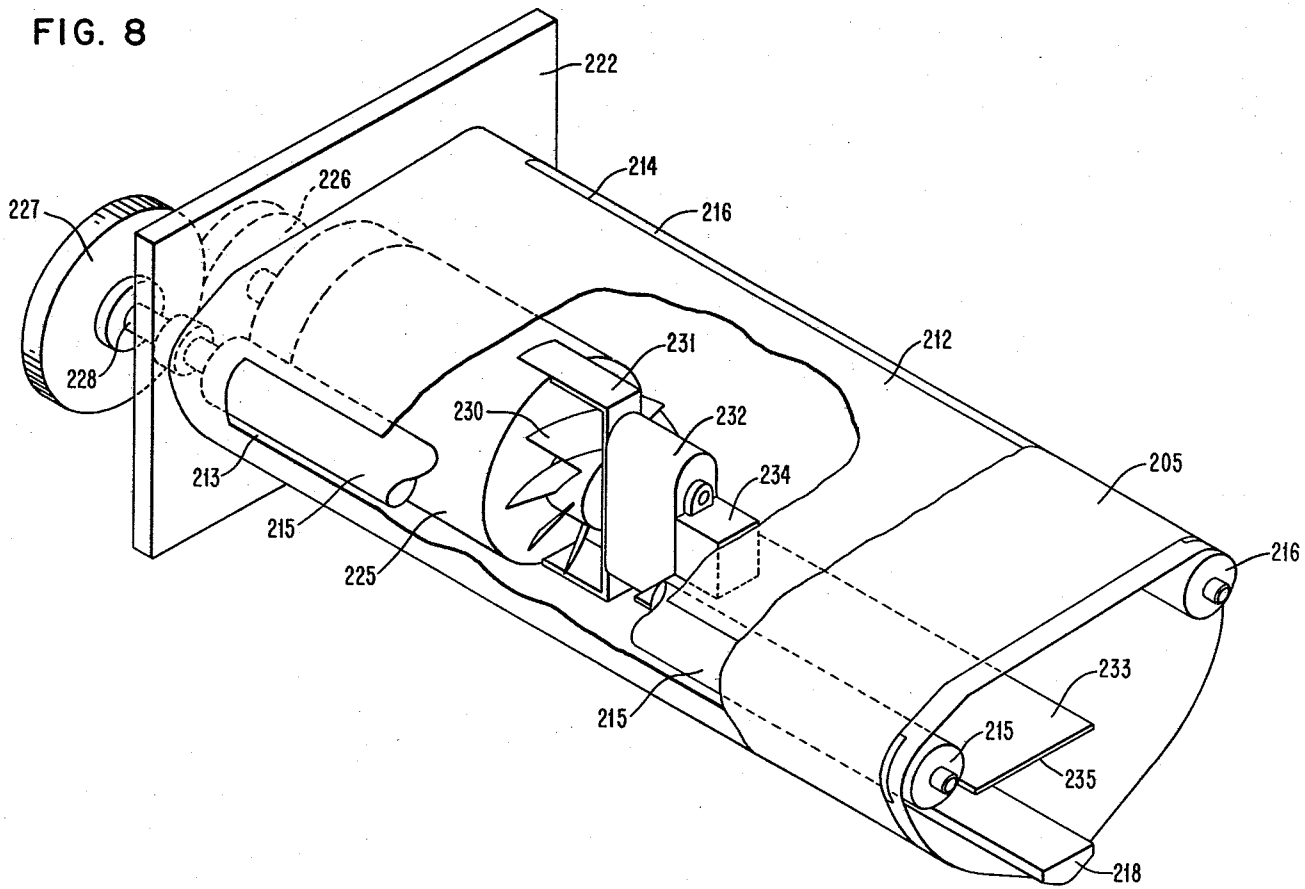
FIG. 8 is an isometric view of typical components mounted in accordance with this invention within the housing for the closed loop photoconductor belt or sleeve of the FIG. 7 copier.

FIGS. 7 and 8 illustrate yet another exemplary embodiment of a compactly configured copier 200 which includes the present invention. Copier 200 accepts original documents which are fed under cover 201 so that they are gripped by the nip between rollers 202 and 203 to be motivated past the scanning location where they are illuminated by dual lamps in housing 204. The image is transferred to a photoconductive belt 205 through a fiber optic array 208. The original documents are then expelled from under cover 201 by rollers 210 and 211.

The closed-loop belt or sleeve 205 is retained in position by a hollow extrusion 212 as best seen in FIG. 8. Housing 212 has a pair of elongated corner slots 213 and 214 with drive rollers 215 and 216 being rotatably mounted below slots 213 and 214, respectively, for allowing rollers 215 and 216 to engage the underside of belt 205. In addition, an outwardly biased tensioning bar 218 extends through another slot in the lower portion of housing 212 to apply slack removing tension to belt 205. Although only a portion of belt 205 is shown in FIG. 8 for clarity, it is to be understood that belt 205 is of a length so as to at least substantially cover slots 213 and 214. Note that FIG. 7 shows the interrelationship of extrusion housing 212 relative to other copier elements such as corona 219, developer housing 220 and paper path assembly 221 which, since they do not form a part of this invention as such, will not be described further.

The extrusion housing 212 is attached to internal sidewall 222 of the copier 200 and includes means [not shown] for rotatably mounting drive rollers 215 and 216. A drive motor 225 is likewise attached to sidewall 222 with the drive shaft on one side thereof passing through wall 222 and being connected to gear 226. gear 226 engages gear 227 which is coupled via shaft 228 back through wall 222 to provide motivational power to driver roller 215. Thus, the closed-loop belt or sleeve 205 is driven by roller 215 in the direction of its closed-loop with roller 216 acting as an idler. As is evident from FIG. 7, the power drive output from gear 227 can be further coupled as to provide motivational power to rollers 202–203 and 210–211.

The drive shaft at the opposite end of motor 225 is connected to a fan 230 which is partially encased by bracket 231. Other elements such as a start capacitor 232 and a printed circuit card 233, along with a usage meter 234 are all connected as a generally inline assembly with motor 225. Although the assembly can be attached in a generally suspended relation within the interior of extruded housing 212 as is illustrated in FIG. 8, it is to be understood that an additional end plate [not shown] can be attached to the machine frame so as to securely receive edge 235 of the circuit card 233. Still further, slots for allowing air flow through the interior of housing 212, such as through end wall 222, can be included as desired as can filter elements for filtering the air being driven through the plenum chamber formed by housing 212.

By the structure and structural interrelationships of the component mounting invention as described above for the preferred embodiments, a multiplicity of multiple functions is obtained from various elements and many advantages become available. The space within the drum or belt shell is fully utilized. The drive motor body becomes an integral structural member of the component mounting assembly and electronic packaging configuration. The fan for cooling the elements thus assembled can be directly attached to the motor shaft and provide cooling air flow with the drum or belt shell acting as a fan plenum when assembled. The drum or belt shell likewise acts as an electronic safety package shield and the printed circuit card and component module act as a drum or belt shell removal and assembly guide. Packaging within the drum or belt keeps electrical connections to a minimum for related savings. Heat from the motor and electronic package can assist for configurations where heater blankets are needed for the photoconductor or other requirements.

Although the present invention has been described with particularity relative to the foregoing detailed description of the exemplary preferred embodiments, various modifications, changes, additions, and applications of the present invention, in addition to those mentioned herein, will be readily apparent to those having normal skill in the art, without departing from the spirit of this invention.

What is claimed is:

1. Electrical component mounting apparatus comprising a frame, a closed loop sleeve mounted relative to said frame for movement in the direction of said closed loop, an elongated assembly including a member having the electrical components attached thereto, said assembly having transverse dimensions for fitting within said sleeve so as to allow said sleeve to move around said member, and means attached to said frame at least at one end of said sleeve for securably receiving said assembly in suspended relation within the interior of said sleeve.

2. Apparatus in accordance with claim 1 which includes fan means mounted for driving cooling air through said sleeve and over said member.

3. Apparatus in accordance with claim 1 wherein said assembly includes a drive motor mounted in-line with said member, and said securably receiving means includes means for attaching said motor to said frame internally of said sleeve at one end thereof.

4. Apparatus in accordance with claim 3 wherein said elongated assembly includes a fan blade coupled for driving by said motor and positioned for motivating air through said sleeve over said elongated assembly.

5. Apparatus in accordance with claim 3 which includes means connected between said motor and said sleeve for applying motivational power to said sleeve in the direction of said closed loop thereof.

6. Apparatus in accordance with claim 3 which includes means transferring power from said motor through said motor attaching means for operating mechanisms external to said sleeve.

7. Apparatus in accordance with claim 6 wherein said sleeve is formed as a cylindrical drum and said power transferring means includes means for applying rotary power to said drum.

8. In a copier having a base machine frame, a photoconductive surfaced sleeve formed in a closed loop having a hollow interior, a multiplicity of operating power requiring components associated with various functions of the copier, a motor having a drive shaft, and electronic components for controlling operation of the copier, an improved apparatus comprising:

first and second collars in spaced relation on said frame and each having bearing surfaces thereon for retaining said sleeve between said collars in a generally fixed location relative to said frame while accommodating movement of said sleeve in the direction of the closed loop thereof over said bearing surfaces, circuit board means having said electronic components mounted thereon in an elongated array, an assembly including bracket means attaching one end of said motor to one end of said circuit board means with said drive shaft in alignment with the direction of the length of said elongated array, first and second means for securing the other ends of said motor and said circuit board means, respectively, to said first and second collars, thereby positioning said assembly relative to said frame, and said bracket means and said motor being arranged for fitting within the interior of said sleeve and in spaced relation to the interior surface of said sleeve when said assembly is positioned therein by said securing means.

9. Apparatus in accordance with claim 8 which includes means for coupling said motor drive shaft through said first collar to at least one of said operating power requiring components.

10. Apparatus in accordance with claim 9 wherein said coupling means includes means for applying drive force to said sleeve from said motor drive shaft.

11. Apparatus in accordance with claim 10 wherein said sleeve is a rotatably mounted drum, said drive force applying means including means for applying rotary force to said drum.

12. Apparatus in accordance with claim 8 which includes a fan blade connected for receiving rotary power from said motor shaft and positioned for impelling air through the interior of said sleeve.

13. Apparatus in accordance with claim 11 wherein said bracket means is formed as a cage containing said fan blade therewithin.

* * * * *